US006073821A

United States Patent [19]

Mercer et al.

[11] Patent Number: 6,073,821

[45] Date of Patent: Jun. 13, 2000

[54] CLOSED-LOOP ADJUSTABLE WATCH BAND

[76] Inventors: Lance Mercer, 2431 W. Calle Retaxa, Tucson, Ariz. 85745; Mike D. Hollo, 1711 N. Village Dr., Tucson, Ariz. 85712

[21] Appl. No.: 09/189,468

[22] Filed: Nov. 10, 1998

[51] Int. Cl.[7] ..... A44C 5/14; A44C 5/22

[52] U.S. Cl. ..... 224/176; 24/265 WS; 368/282

[58] Field of Search ..... 224/176, 177, 224/164; 368/282; 24/265 WS

[56] References Cited

U.S. PATENT DOCUMENTS

| | | | |
|---|---|---|---|
| 811,767 | 2/1906 | Drews | 224/176 |
| 1,222,391 | 4/1917 | Grant | 224/176 |
| 1,765,966 | 6/1930 | Clark | 224/164 |
| 3,747,171 | 7/1973 | Montague, Jr. | 24/264 WS |
| 4,103,808 | 8/1978 | Hallman et al. | 224/176 |
| 4,779,249 | 10/1988 | Rappaport | 368/276 |
| 4,862,436 | 8/1989 | Harilela | 368/282 |
| 5,215,235 | 6/1993 | Maekawa et al. | 224/176 |
| 5,425,007 | 6/1995 | Walter et al. | 368/282 |

FOREIGN PATENT DOCUMENTS

| | | | |
|---|---|---|---|
| 26717 | 7/1913 | United Kingdom | 224/176 |

*Primary Examiner*—Stephen P. Garbe
*Attorney, Agent, or Firm*—Joseph N. Breaux

[57] ABSTRACT

A closed-loop adjustable watch band that includes a main strap member; a first slide loop secured to the first strap member end of the main strap member; a first strap section of the main strap member threaded through the first slide loop; a second slide loop secured to the second strap member end of the main strap member; a second strap section of the main strap member that is closer to the first strap member end than the first strap section threaded through the second slide loop; a first fastener section of hook and pile fastener material provided on the outwardly facing surface of the main strap member and positioned adjacent to the closed securement loop such that the closed securement loop is positioned between the first fastener section and the first strap member end of the main strap member; and a size adjustment strap having a first adjustment strap end secured to the second strap member end of the main strap member and a second adjustment strap end provided with a second fastener section of hook and pile fastener material that is companionate with the first fastener section.

5 Claims, 2 Drawing Sheets

FIG.1
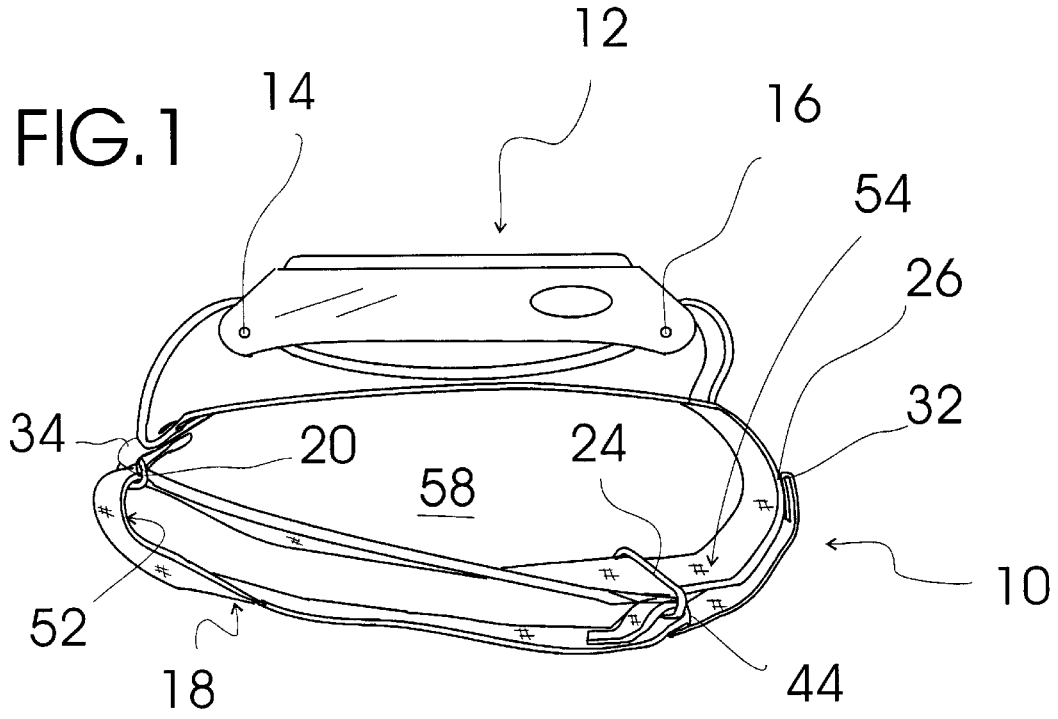
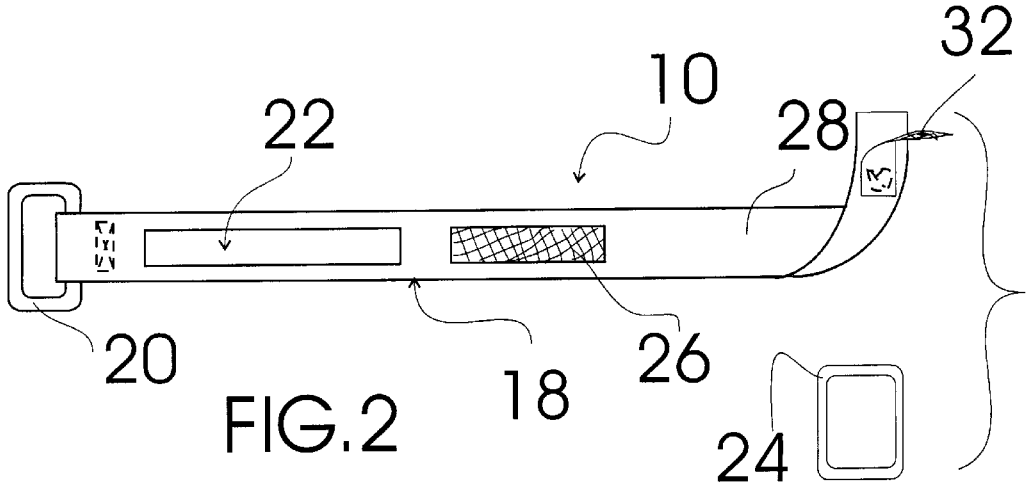
FIG.2

FIG.4
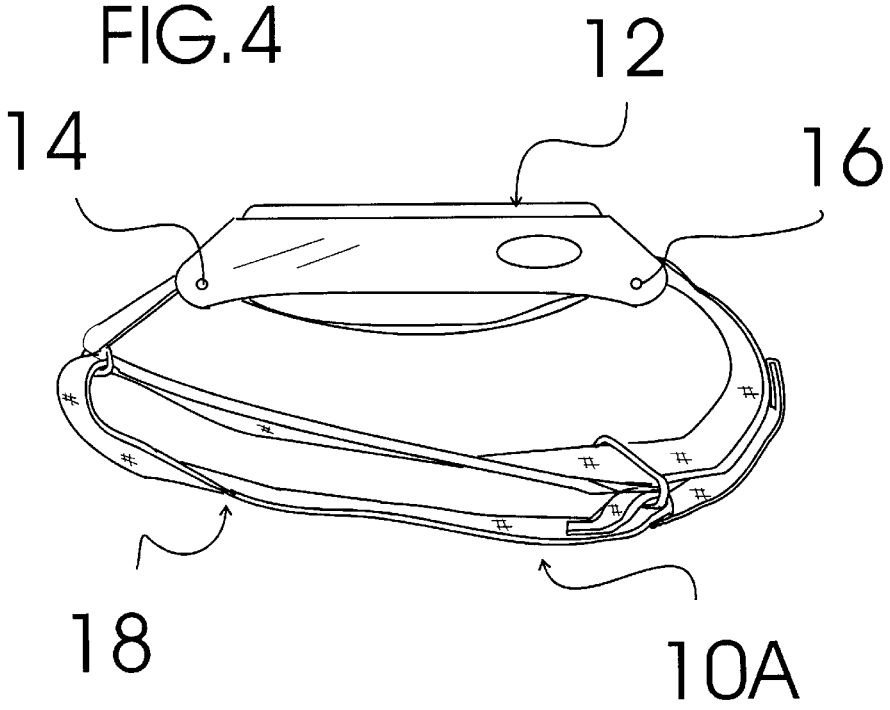
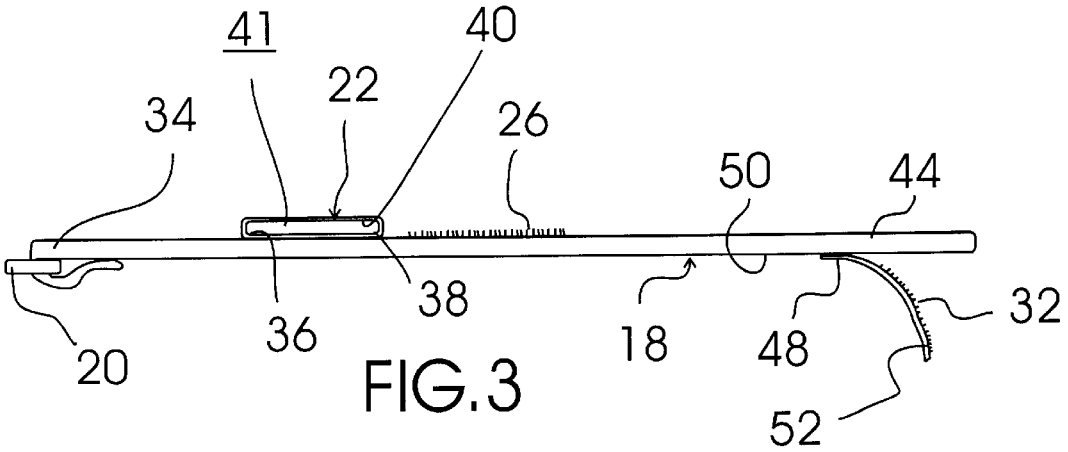
FIG.3

CLOSED-LOOP ADJUSTABLE WATCH BAND

TECHNICAL FIELD

The present invention relates to watch bands and more particularly to a closed-loop adjustable watch band for use with a wrist watch body having a left and a right watch pin; the closed loop adjustable watch band including a main strap member; a first slide loop secured to the first strap member end of the main strap member; a first strap section of the main strap member threaded through the first slide loop; a second slide loop secured to the second strap member end of the main strap member; a second strap section of the main strap member that is closer to the first strap member end threaded through the second slide loop; a first fastener section of hook and pile fastener material provided on the outwardly facing surface of the main strap member; and a size adjustment strap fastener section of hook and pile fastener material that is companionate with the first fastener section; the size adjustment strap fastener section having a first adjustment strap end secured to the second strap member end of the main strap member.

BACKGROUND OF INVENTION

Watch bands typically include two watch band ends that are each independently secured to the watch body of a wrist watch by a watch pin. If either one of the watch pins fails, the band formed around the wrist of the user is broken and the watch body can fall to the ground resulting in damage to the watch. It would be a benefit, therefore, to have a watch band that utilized two watch pins to secure the watch body to a closed loop wrist band that was securable to the wrist of a user by a loop adjustment mechanism. Using two pins to secure the watch body to the closed loop wrist band requires both of the watch pins to fail before the watch body can fall from the wrist bad. In addition, use of a closed loop wrist band with a loop adjustment mechanism provides the wearer with addition protection. Should the loop adjustment mechanism fail, the closed loop construction of the wrist band provides the user with the chance that the wrist band will remain around the wrist of the wearer for a sufficient period of time to allow the wearer to grasp the watch and prevent damage to or loss of the watch.

SUMMARY OF INVENTION

It is thus an object of the invention to provide a closed-loop adjustable watch band to which a watch body can be attached with two watch pins.

It is a further object of the invention to provide a closed-loop adjustable watch band that includes a main strap member; a first slide loop secured to the first strap member end of the main strap member; a first strap section of the main strap member threaded through the first slide loop; a second slide loop secured to the second strap member end of the main strap member; a second strap section of the main strap member that is closer to the first strap member end threaded through the second slide loop; a first fastener section of hook and pile fastener material provided on the outwardly facing surface of the main strap member; and a size adjustment strap fastener section of hook and pile fastener material that is companionate with the first fastener section; the size adjustment strap fastener section having a first adjustment strap end secured to the second strap member end of the main strap member.

It is a still further object of the invention to provide a closed-loop adjustable watch band that accomplishes both of the above objects in combination.

Accordingly, a closed-loop adjustable watch band is provided. The closed-loop adjustable watch band includes a main strap member; a first slide loop secured to the first strap member end of the main strap member; a first strap section of the main strap member threaded through the first slide loop; a second slide loop secured to the second strap member end of the main strap member; a second strap section of the main strap member that is closer to the first strap member end threaded through the second slide loop; a first fastener section of hook and pile fastener material provided on the outwardly facing surface of the main strap member; and a size adjustment strap fastener section of hook and pile fastener material that is companionate with the first fastener section; the size adjustment strap fastener section having a first adjustment strap end secured to the second strap member end of the main strap member. The first and second slide loops are preferably formed from metal. The main strap member is preferably constructed from a length of woven nylon strapping material.

In a preferred embodiment, the closed-loop adjustable watch band includes a main strap member; a first slide loop secured to the first strap member end of the main strap member; a watch securement strap secured at both securement strap ends to an outwardly facing surface of the main strap member to form a closed securement loop; a first strap section of the main strap member threaded through the first slide loop; a second slide loop secured to the second strap member end of the main strap member; a second strap section of the main strap member that is closer to the first strap member end threaded through the second slide loop; a first fastener section of hook and pile fastener material provided on the outwardly facing surface of the main strap member and positioned adjacent to the closed securement loop such that the closed securement loop is positioned between the first fastener section and the first strap member end of the main strap member; and a size adjustment strap fastener section of hook and pile fastener material that is companionate with the first fastener section; the size adjustment strap fastener section having a first adjustment strap end secured to the second strap member end of the main strap member.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the closed-loop adjustable watch band of the present invention in use with a conventional wrist watch body having a left and a right watch pin that shows the main strap member; the first metal slide loop secured to the first strap member end of the main strap member; the watch securement strap secured at both securement strap ends to an outwardly facing surface of the main strap member to form a closed securement loop; a first strap section of the main strap member threaded through the first metal slide loop; a second metal slide loop secured to the second strap member end of the main strap member; a second strap section of the main strap member that is closer to the first strap member end threaded through the second metal slide loop; a first fastener section of hook and pile fastener material provided on the outwardly facing surface of the main strap member and positioned adjacent to the closed securement loop such that the closed securement loop is positioned between the first fastener section and the first strap member end of the main strap member; and a size adjustment strap fastener section of hook and pile fastener material that is companionate with the first fastener section; the size adjustment strap fastener section having a first adjustment strap end secured to the second strap member end of the main strap member.

FIG. 2 is a top plan view of the exemplary closed-loop adjustable watch band of FIG. 1 in isolation and partially disassembled showing the main strap member; the first metal slide loop secured to the first strap member end of the main strap member; the second metal slide loop detached from the second strap member end of the main strap member; the first fastener section of hook and pile fastener material; and the size adjustment strap section.

FIG. 3 is a side plan view of the exemplary closed-loop adjustable watch band of FIG. 1 in isolation and partially disassembled showing the main strap member; the first metal slide loop secured to the first strap member end of the main strap member; the first fastener section of hook and pile fastener material; and the size adjustment strap section.

FIG. 4 is a perspective view of a second, simpler, exemplary embodiment of the closed-loop adjustable watch band of the present invention that is identical to the watch band of FIG. 1 except the watch securement strap has been eliminated and the left and right watch pins of the watch body are secured about the main strap member.

EXEMPLARY EMBODIMENTS

FIG. 1 shows an exemplary embodiment of the closed-loop adjustable watch band of the present invention, generally designated by the numeral 10, in use with a conventional wrist watch body, generally designated 12, having conventional left and right watch securing pins 14,16. With reference to FIG. 2, watch band 10 includes a woven nylon main strap member, generally designated 18; a first metal slide loop 20; a second metal slide loop 24; a first fastener section 26 of hook and pile fastener material provided on an outwardly facing surface 28 of main strap member 18; and a size adjustment strap section 32 of hook and pile fastener material.

With reference to FIG. 3, first metal slide loop 20 is secured to a first strap member end 34 by folding an end section of main strap member 18 over and through first metal slide loop 20 and then securely stitching it in place.

With reference to FIG. 1, second metal slide loop 24 is secured to a second strap member end 44 of main strap member 18 in the same manner as first metal slide loop 20 is secured to first strap member end 34.

With reference back to FIG. 3, first fastener section 26 of hook and pile fastener material is stitched to the outwardly facing surface 28 (FIG. 2) of main strap member 18 and positioned adjacent to closed securement loop 40 such that closed securement loop 40 is positioned between first fastener section 26 and first strap member end 34. Size adjustment strap section 32 is a length of hook and pile fastener material having a woven nylon strap backing material that has a first adjustment strap end 48 secured to second strap member end 44 on an opposite side surface 50 of main strap member 18 and also has a second adjustment strap end 52 that has second fastener section 32 of hook and pile fastener material provided thereon.

With reference back to FIG. 1, during assembly of watchband 10, main strap member 18 is threaded through first and second metal slide loops 20, 24 such that a first strap section, generally indicated 52, of main strap member 18 is threaded through first metal slide loop 20 and a second strap section, generally designated 54, of main strap member 18 that is closer to first strap member end 34 than first strap section 52 is threaded through second metal slide loop 24 to form an adjustable wrist receiving opening 58. The size of wrist receiving opening 58 is adjusted by securing size adjustment strap section 32 of hook and pile material to a desired portion of first section 26 (also shown in FIGS. 2 and 3).

FIG. 4 shows a second, simpler, exemplary embodiment of the closed-loop adjustable watch band of the present invention, generally designated by the numeral 10*a*. Watch band 10*a* is identical to watch band 10 of FIG. 1 except that in watch band 10*a* the watch securement strap has been eliminated. In use, watch band 10*a* is used by securing the left and right watch pins 14,16 of the watch body 12 about main strap member 18.

It can be seen from the preceding description that a closed-loop adjustable watch band has been provided that includes a closed securement loop to which a watch body can be attached with two watch pins; and that includes a main strap member; a first slide loop secured to the first strap member end of the main strap member; a first strap section of the main strap member threaded through the first slide loop; a second slide loop secured to the second strap member end of the main strap member; a second strap section of the main strap member that is closer to the first strap member end threaded through the second slide loop; a first fastener section of hook and pile fastener material provided on the outwardly facing surface of the main strap member and positioned adjacent to the closed securement loop such that the closed securement loop is positioned between the first fastener section and the first strap member end of the main strap member; and a size adjustment strap having a first adjustment strap end secured to the second strap member end of the main strap member and a second adjustment strap end provided with a second fastener section of hook and pile fastener material that is companionate with the first fastener section.

It is noted that the embodiment of the closed-loop adjustable watch band described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A closed-loop adjustable watch band comprising:

a main strap member having a first strap member end, a second strap member end, and an outwardly facing surface;

a first slide loop secured to said first strap member end of said main strap member;

a first strap section of said main strap member threaded through said first slide loop;

a second slide loop secured to said second strap member end of said main strap member;

a second strap section of said main strap member threaded through said second slide loop; said second strap section being closer to said first strap member end than said first strap section is; a first fastener section of hook and pile fastener material provided on said outwardly facing surface of said main strap member; and a size adjustment strap fastener section of hook and pile fastener material that is companionate with said first fastener section;

said size adjustment strap fastener section having a first adjustment strap end secured to said second strap member end of said main strap member.

2. The closed-loop watch band of claim 1 wherein:

said first and second slide loops are formed from metal.

3. The closed-loop watch band of claim 1 wherein:

said main strap member is constructed from a length of woven nylon strapping material.

4. The closed-loop watch band of claim 3 wherein:

said first and second slide loops are formed from metal.

5. A closed-loop watch band comprising:

a main strap member having a first strap member end, a second strap member end, and an outwardly facing surface;

a first slide loop secured to said first strap member end of said main strap member;

a watch securement strap secured at both securement strap ends to an outwardly facing surface of said main strap member to form a closed securement loop;

a first strap section of said main strap member threaded through said first slide loop;

a second slide loop secured to said second strap member end of said main strap member;

a second strap section of said main strap member threaded through said second slide loop said second strap section being closer to said first strap member end than said first strap section is;

a first fastener section of hook and pile fastener material provided on said outwardly facing surface of said main strap member and positioned adjacent to said closed securement loop such that said closed securement loop is positioned between said first fastener section and said first strap member end of said main strap member; and a size adjustment strap fastener section of hook and pile fastener material that is companionate with said first fastener section;

said size adjustment strap fastener section having a first adjustment strap end secured to said second strap member end of said main strap member.

* * * * *